United States Patent [19]

Kowalski et al.

[11] 4,309,849

[45] Jan. 12, 1982

[54] WORKPIECE HOLDER

[75] Inventors: Melvin Kowalski, Lambertville, Mich.; E. N. Stefanelli, Perrysburg, Ohio

[73] Assignee: Teledyne Industries, Inc., Los Angeles, Calif.

[21] Appl. No.: 69,306

[22] Filed: Aug. 24, 1979

Related U.S. Application Data

[63] Continuation of Ser. No. 875,196, Feb. 6, 1978, abandoned.

[51] Int. Cl.[3] ..... B24B 41/06

[52] U.S. Cl. ..... 51/237 R; 269/270; 51/217 T

[58] Field of Search ..... 269/7, 270; 51/237 R, 51/236, 217 T, 105 R; 279/1 SJ

[56] References Cited

U.S. PATENT DOCUMENTS

| | | | |
|---|---|---|---|
| 1,227,243 | 5/1917 | Bugbee | 51/217 T |
| 1,885,848 | 11/1932 | March | 51/237 |
| 2,612,082 | 9/1952 | Angell | 269/270 |
| 3,068,619 | 12/1962 | Mertley | 51/237 R |
| 3,487,857 | 1/1970 | Lee | 269/270 |
| 3,631,637 | 1/1972 | Tagnon | 51/237 R |

*Primary Examiner*—Harold D. Whitehead

*Attorney, Agent, or Firm*—Gifford, Van Ophem, Sheridan & Sprinkle

[57] ABSTRACT

A workpiece holder is provided for holding a workpiece, such as an airfoil, during a machining operation. The holder comprises a first jaw having a first resilient member shaped to conform to one side of the workpiece and a second jaw having a second resilient member shaped to conform to the other side of the workpiece. The jaws are secured together with the workpiece sandwiched therebetween so that the resilient members in the respective jaws abut against and hold the workpiece during a subsequent machining operation.

18 Claims, 5 Drawing Figures

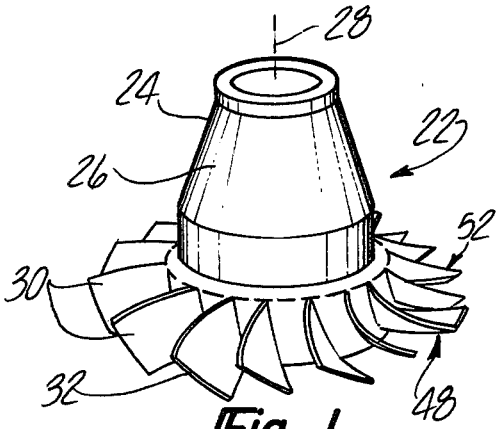
Fig-1
Fig-2
PRIOR ART
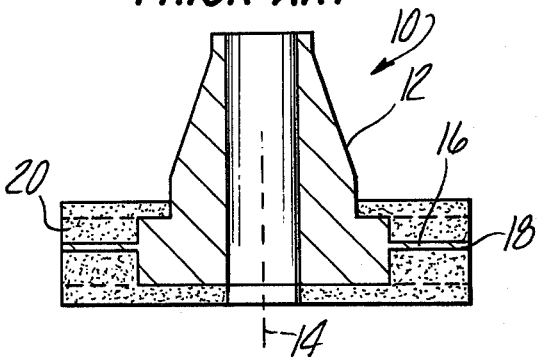
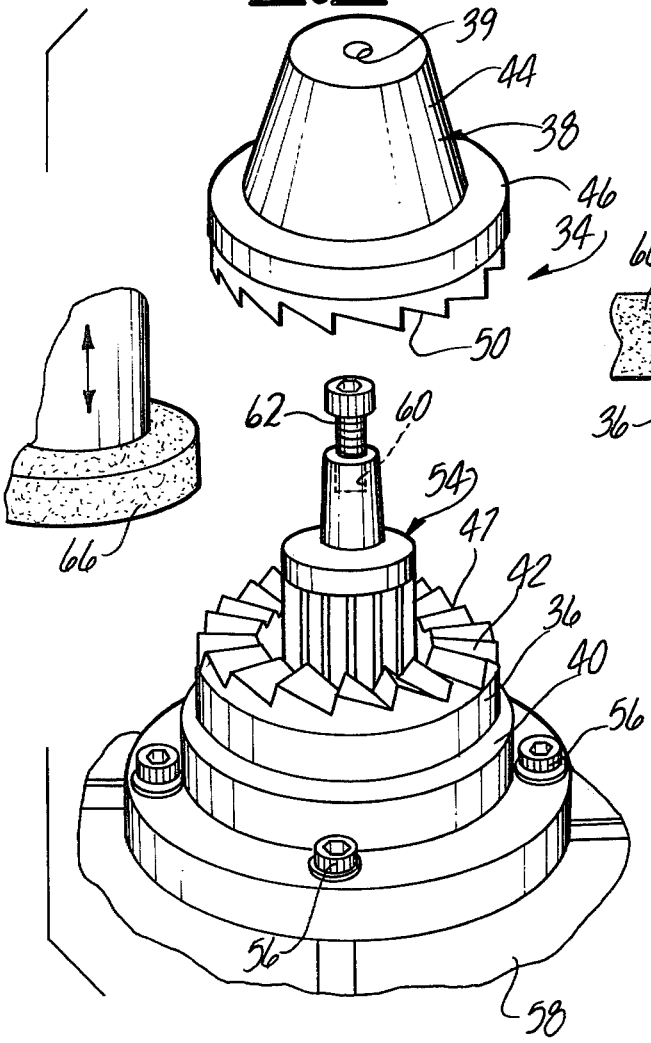
Fig-3
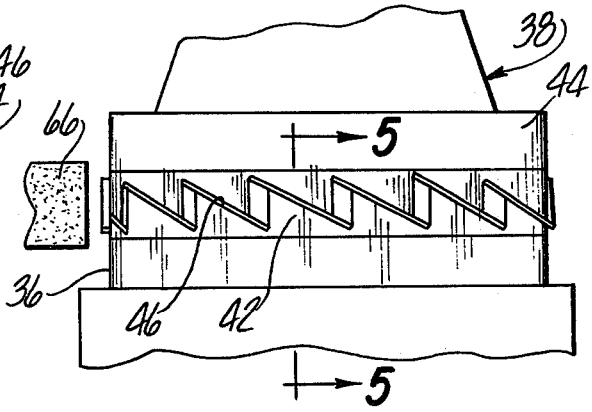
Fig-4
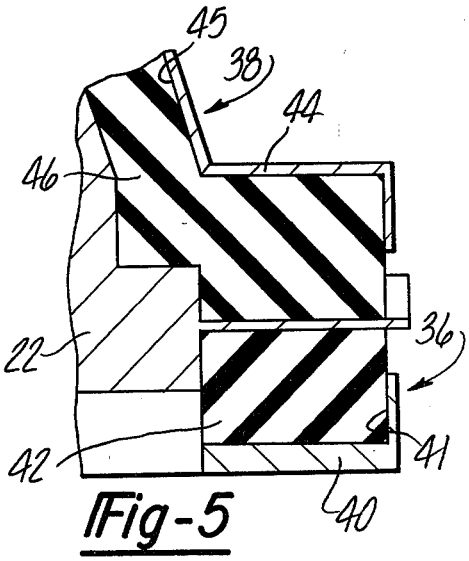
Fig-5

WORKPIECE HOLDER

CROSS REFERENCE TO RELATED APPLICATIONS

This is a continuation application Ser. No. 875,196, filed Feb. 6, 1978.

BACKGROUND OF THE INVENTION

I. Field of the Invention

The present invention relates generally to workpiece holders and, more particularly, to a workpiece holder for holding the work during a machining operation.

II. Description of the Prior Art

The machining of airfoils or similar objects that cannot tolerate vibration during the machining process has proven to be a major challenge in the machining art. When conventional machining methods are employed with such workpieces, these workpieces shatter, or are otherwise rendered unusable.

The prior art solution to this problem is depicted in FIG. 2 in which an airfoil 10 is shown as a turbine rotor having a hub 12 adapted to rotate about an axis 14 of rotation. A plurality of turbine blades 16 are secured and extend radially outwardly from the hub 12. The turbine blades 16 are thin and usually brittle, oftentimes constructed of ceramic or similar materials, and must be supported against destructive vibration during conventional machining operations. One standard and conventional machining operation for turbine rotors is to grind the outer tips 18 of the turbine blades 16 to a predetermined radius with respect to the axis of rotation 14 of the airfoil 10.

Still referring to FIG. 2, in order to support the turbine blades 16 against vibration during the machining process, it has been the previous practice to encase all of the turbine blades in a heavy metal alloy 20, known in the art as matrix. The machining operation is then carried out, typically by rotating the airfoil 10 at high speed around the axis of rotation 14 and applying a spinning grinding wheel to the outer tips 18 of the turbine blades 16. After completion of the grinding operation, the matrix 20 is melted and drained away from the airfoil 10 thus leaving the completed airfoil 10.

This previously known use of martrix 20 to hold the blades 16 rigid during the machining operation is disadvantageous in several different respects. First, the use of matrix 20 requires that each part must be individually poured and encased with the matrix 20 prior to the machining operation in addition to being melted away following the completion of the machining operation. These steps of casting and subsequently melting the matrix 20 not only are time consuming but also require expensive tooling for both processes.

A still further disadvantage of the use of matrix is that the added weight of the matrix increases the difficulty in handling the airfoil 10 with the matrix 20. The increased difficulty in handling increases the overall labor costs for the machining process.

A still further disadvantage of using the matrix is that the material cost of matrix is very expensive. Moreover, a portion of the matrix 20 is lost both during the machining operation and also during the melting or matrix recovery operation. Contamination of the matrix during the recovery operation also results in expensive matrix losses.

A final, but substantial disadvantage of the use of matrix is that the matrix became embedded in or loaded on the grinding wheel during the grinding machine operation. As a result of this, a turned finish on the blade tips 18 was previously the best finish obtainable for a grinding operation.

SUMMARY OF THE PRESENT INVENTION

The present invention eliminates all of these previously known problems and the disadvantages by providing a split rubber mold for holding an airfoil or similar workpiece during a machining operation.

In brief, the present invention comprises a first jaw having a first resilient member shaped to conform to one side or axial end of the workpiece. A second jaw is also provided and includes a second resilient member shaped to conform to the other side or axial end of the airfoil.

The jaws are secured together with the workpiece to be machined positioned therebetween so that the resilient members flatly abut against their respective sides of the workpiece. The resilient members in the jaws are preferably slightly compressed against the workpiece which simply but effectively dampens the workpiece against vibration during a subsequent machining operation. Following the machining operation, the jaws are separated and the finished machine part is removed. Thereafter, a subsequent workpiece can be sandwiched between the jaws for the same or similar machine operation. The jaws are preferably described as mold parts since the resilient members for the respective mold parts are preferably formed by casting molten rubber or similar material around the part to be machined. This process insures a continuous contact between the resilient members and the part to be machined.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which:

FIG. 1 is a perspective view illustrating one type of workpiece with which the holder according to the present invention can be employed;

FIG. 2 is a drawing illustrating a previously known means for holding the workpiece during a machine operation;

FIG. 3 is a fragmentary exploded view showing the holder according to the present invention;

FIG. 4 is a fragmentary side plan view showing the holder of the present invention; and FIG. 5 is a fragmentary sectional view taken substantially along line 5—5 in FIG. 4 and enlarged for clarity.

DETAILED DESCRIPTION OF THE PRESENT INVENTION

With reference first to FIG. 1, an exemplary workpiece 22 is thereshown as an airfoil 24 of the type having a hub 26 adapted to rotate about an axis 28 and with a plurality of blades 30 secured to and extending radially outwardly from the hub 26. The airfoil 24 shown in FIG. 1 corresponds to the prior art workpiece 10 in FIG. 2 and is depicted as an axial compressor for a turbine engine. It will be understood, however, that the invention to be subsequently described can be employed with other types of workpieces without departure from the spirit or scope of the invention. In addition, for purposes of description only, the present invention will be described for use in holding the workpiece 22 during a grinding operation on the outer tips 32 of the blades 30.

With reference now to FIGS. 3–5 the workpiece holder 34 according to the present invention is thereshown and comprises a first mold part 36 and a second mold part 38. The first mold part 36 further comprises an annular outer housing 40 which carries a first resilient member 42 within its interior 41 (FIG, 5). Similarly, the second mold part 38 comprises a conical outer housing 44 which carries a second resilient member 46 within its interior 45 (FIG. 5). The resilient members 42 and 46 are preferably constructed of rubber or a similar resilient material.

The upper exposed face 47 (FIG. 3) of the first mold part is shaped to conform with one side of the workpiece 22, i.e. the lower axial end 48 (FIG. 1) of the workpiece blades 30 for the example used, and therefore, is annular in shape. Similarly, the exposed face 50 (FIG. 3) of the second resilient member 46 corresponds or conforms to the shape of the other axial end 52 (FIG. 1) of the workpiece blades 30 and is likewise annular in shape. The radius of each resilient member 42 or 46, however, is slightly smaller than the radius of the airfoil blades 30 for a reason to be subsequently described.

Both the resilient members 42 and 46 are formed by casting molten resilient material onto the workpiece 22 which is to be machined. By doing so, the exposed faces 47 and 50 of the resilient members 42 and 46, respectively, will precisely conform to the workpiece 22 to be machined. The formation of the resilient members 42 and 46 by casting can be simply and rapidly accomplished.

One method of forming the resilient members 42 and 46 would be to first apply a suitable parting agent to the surfaces of the workpiece 22. A thermosetting resilient material, such as the rubberlike plastic materials that are now available, is there poured over the workpiece 22 to completely cover both sides of it. After sufficient time has elapsed to permit the material to harden it is cut away to expose the tips of the blades 30. This will permit the material to be separated radially to expose the workpiece and will then produce the resilient members 42 and 46. The excess resilient material then can be cut away and the housing members 40 and 44 attached by an adhesive or the like to form the mold parts 36 and 38. The mold parts 36 and 38 then can, of course, be used over and over again to hold workpieces like the original workpiece 22.

With particular reference to FIG. 3, the holder 34 is adapted for use with machinery which may include a spindle 54, dimensioned so that it can be positioned within the interior of the workpiece hub 26, extending coaxially upwardly through the first mold part 36. Both the spindle 54 and the housing 40 for the first mold part 36 are secured by suitable fasteners 56 to rotatable members 58 coaxial with both the axis of the spindle 54 and the axis of the first mold part 36. A threaded bore 60 at the upper end of the spindle 54 threadably receives a threaded fastener 62.

In operation, the workpiece 22 is positioned over the spindle 54 such that the lower axial end 48 of the workpiece 22 flatly abuts against the upper formed surface 47 of the first resilient member 42 (FIG. 4). Thereafter, the second mold part 38 is positioned over the workpiece 22 such that the lower formed surface 50 of the second resilient member 46 flatly abuts against the upper axial end 52 of the turbine blades 30. Since the resilient members 42 and 46 are formed by casting the resilient material upon the turbine blades 30, the resilient members 42 and 46 substantially flatly or continuously abut against the blades 30 on the workpiece 22.

Thereafter, the fastener 62 is inserted through a bore 39 in the second housing part 38 and is screwed into the spindle bore 60 to secure the mold parts 36 and 38 together. Preferably the fastener 62 is sufficiently tightened to slightly compress the resilient members 42 and 46 and insure a continuous contact or abutment between the resilient member 42 and 46 and the workpiece blades 30. Since the diameters of the resilient members 42 and 46 are slightly less than that of the turbine blades 30, the outer tips 32 of the blades 30 protrude slightly outwardly from the mold parts 36 and 38 as best shown at in FIGS. 4 and 5.

With the workpiece 22 sandwiched between the mold parts 36 and 38 with their respective resilient members 42 and 46, the holder 34 according to the present invention simply but effectively prevents vibration of the workpiece blades 30 during a machine operation. One such machine operation is shown in FIGS. 3 and 4 in which the member 58 is rotated at high speed while a spinning grinding wheel 66 is moved radially toward the blade tips 32. Contact between the grinding wheel 66 and the blade tips 32 will grind the blades 30 to a predetermined radius with respect to the axis 28 of rotation of the workpiece 22.

Upon completion of the machine or grinding operation, the threaded fastener 62 and the second mold part 38 are both removed from the spindle 54. The finished workpiece 22 is removed from the spindle 54. The holder 34 according to the present invention is then ready for the insertion of a subsequent workpiece 22 to be machined so that the holder can be repeatedly used.

From the foregoing it can be seen that the workpiece holder 34 according to the present invention provides a substantial improvement over the previously known machining method depicted in FIG. 2. The holder 34 according to the present invention permits the rapid machining of multiple workpieces (of the same type) without the previously known necessity for casting the individual workpieces in matrix and thereafter melting the matrix to recover it. As a result the overall machining time for each workpiece 22 is drastically reduced along with the material cost, handling difficulties and complex equipment required with matrix. As an additional advantage of the present invention, a better and smoother finish can be obtained on the tips 32 of the blades 30 since the grinding wheel 66 contacts and grinds only the blade tips 32.

While the present invention has been described as a holder for a turbine wheel airfoil, it will be understood that the holder 34 according to the present invention can be employed with other types of brittle workpieces which are intolerant of vibration during a machining operation.

Having described our invention, however, many modifications thereto will become apparent to those skilled in the art to which it pertains without deviation from the spirit of the invention as defined by the scope of the appended claims.

We claim:

1. An apparatus for holding a workpiece having curved, spaced apart, radial projections during a machining operation upon the radial tips of said projections comprising:

a first workpiece holding jaw, said first jaw having a first member made of a first resilient material and formed by casting the first resilient material onto one side of a workpiece so that the first member defines a plurality of gripping surfaces which continuously engage substantially the entire said one side of the radial projections despite the curved configuration of said one side of the radial projections;

a second workpiece holding jaw, said second jaw having a second member made of a second resilient material and formed by casting the second resilient material onto the opposite side of the radial projections so that the second member defines a plurality of gripping surfaces which engage substantially the entire said opposite side of the radial projections despite the curved configuration of said opposite side of the radial projections; and means for axially compressing the jaws together with a workpiece positioned therebetween, whereby the gripping surfaces of said jaws flatly abut against their respective sides of the radial projections.

2. The apparatus as defined in claim 1 wherein the first jaw includes an outer housing in which at least a portion of the first resilient member is carried.

3. The apparatus as defined in claim 1 wherein the second jaw includes an outer housing in which at least a portion of the second resilient member is carried.

4. The apparatus as defined in claim 1 and including means for compressing said resilient members against their respective sides of the workpiece.

5. The apparatus as defined in claim 4 wherein said compressing means further comprises threaded means for operatively engaging both jaws whereby rotation of the threaded means in one rotational direction moves the mold parts toward each other.

6. The apparatus as defined in claim 1 and in which the radii of the jaws are substantially equal and are only slightly less than the radius of said workpiece.

7. The apparatus as defined in claim 1 in which said workpiece is a turbine rotor having a hub adapted to rotate about an axis and wherein said radial projections comprise a plurality of blades extending radially outwardly from the hub and wherein the first resilient member abuts against one axial side of the blades while the second resilient member abuts against the other axial side of the blades.

8. The apparatus as defined in claim 7 wherein said first and second resilient members each have a circular periphery with a diameter less than the diameter of said turbine rotor whereby the outer tips of the blades protrude radially outwardly from between the resilient members.

9. The apparatus as defined in claim 1 wherein at least one of the resilient materials is rubber.

10. The apparatus as defined in claim 1 wherein the first and second resilient materials are substantially the same.

11. An apparatus for holding a turbine wheel having a hub adapted to rotate about an axis and a plurality of spaced, radially outwardly extending blades, during a machining operation on the tips of said blades, said blades being, brittle, thin walled, and circumferentially spaced and separated from each other, said blades being curved obliquely to the axis of rotation of the hub and thus forming an irregular surface with respect to the axis of rotation of the hub, said apparatus comprising:

a first jaw, said jaw having a first resilient member with a gripping surface shaped to conform to the curved surface of each blade on one side of the blades of the turbine wheel;

a second jaw, said second jaw having a second resilient member with a gripping surface shaped to conform to the curved surface of each blade on the other side of the blades of the turbine wheel; and means for securing and axially compressing said jaws together with the blades of the turbine wheel positioned therebetween whereby the resilient members flatly abut against substantially all of the surface area of the blades of the turbine wheel but so that the radially outer tips of the blades protrude outwardly from between the jaws, whereby the jaws dampen vibration of the blades during a machining operation on said blade tips, and whereby the compression forces of said jaws against said blades maintains said turbine wheel blades in their original plane with respect to the turbine wheel hub.

12. The apparatus as defined in claim 11 wherein the first jaw includes an outer housing in which at least a portion of the first resilient member is carried.

13. The apparatus as defined in claim 11 wherein the second jaw includes an outer housing in which at least a portion of the second resilient member is carried.

14. The apparatus as defined in claim 12 in which at least one resilient member is made of rubber.

15. The apparatus as defined in claim 12 in which both resilient members are made of rubber.

16. The apparatus as defined in claim 12 wherein said resilient members are formed by casting the material of which the resilient members are formed onto the turbine wheel blades to be machined.

17. The apparatus as defined in claim 12 and including means for compressing said resilient members against their respective sides of the turbine wheel blades.

18. The apparatus as defined in claim 17 wherein said compressing means further comprises threaded means for operatively engaging both jaws whereby rotation of the threaded means in one rotational direction moves the jaws toward each other.

* * * * *